US009382787B2

(12) United States Patent
Naedler et al.

(10) Patent No.: US 9,382,787 B2
(45) Date of Patent: Jul. 5, 2016

(54) SEAT ASSEMBLY FOR ISOLATING FRACTURE ZONES IN A WELL

(71) Applicant: UTEX Industries, Inc., Houston, TX (US)

(72) Inventors: Mark H. Naedler, Cypress, TX (US); Derek L. Carter, Houston, TX (US); Wesley P. Michalcik, Hallettsville, TX (US)

(73) Assignee: UTEX Industries, Inc., Houston, TX (US)

( * ) Notice: Subject to any disclaimer, the term of this patent is extended or adjusted under 35 U.S.C. 154(b) by 730 days.

(21) Appl. No.: 13/676,238

(22) Filed: Nov. 14, 2012

(65) Prior Publication Data

US 2013/0133876 A1 May 30, 2013

Related U.S. Application Data

(60) Provisional application No. 61/559,494, filed on Nov. 14, 2011.

(51) Int. Cl.

| | |
|---|---|
| ***E21B 43/26*** | (2006.01) |
| ***E21B 43/16*** | (2006.01) |
| ***E21B 34/14*** | (2006.01) |
| *E21B 43/14* | (2006.01) |
| *E21B 33/00* | (2006.01) |
| *E21B 34/00* | (2006.01) |

(52) U.S. Cl.

CPC ..... *E21B 43/16* (2013.01); *E21B 34/14* (2013.01); *E21B 43/14* (2013.01); *E21B 43/26* (2013.01); *E21B 2033/005* (2013.01); *E21B 2034/007* (2013.01)

(58) Field of Classification Search

CPC ..... E21B 34/06; E21B 34/08; E21B 34/10; E21B 34/14; E21B 33/12; E21B 33/124; E21B 43/16; E21B 43/26; E21B 43/14; E21B 2033/05; E21B 2034/007

See application file for complete search history.

(56) References Cited

U.S. PATENT DOCUMENTS

| | | | | |
|---|---|---|---|---|
| 4,510,994 | A | 4/1985 | Pringle | |
| 5,165,473 | A | 11/1992 | Bode | |
| 6,053,250 | A | 4/2000 | Echols | |
| 2005/0178552 | A1 * | 8/2005 | Fehr et al. | 166/305.1 |
| 2008/0066924 | A1 | 3/2008 | Xu | |
| 2009/0044949 | A1 * | 2/2009 | King et al. | 166/332.4 |
| 2009/0159289 | A1 | 6/2009 | Avant et al. | |
| 2011/0030947 | A1 * | 2/2011 | Schreiber et al. | 166/250.01 |
| 2011/0192613 | A1 * | 8/2011 | Garcia et al. | 166/373 |
| 2011/0277989 | A1 * | 11/2011 | Frazier | 166/193 |
| 2012/0012771 | A1 * | 1/2012 | Korkmaz et al. | 251/315.07 |

OTHER PUBLICATIONS

International Search Report and Written Opinion for PCT/US2012/069883, Korean Intellectual Property Office, mailed Apr. 12, 2013, 9 pages.

* cited by examiner

*Primary Examiner* — Robert E Fuller
*Assistant Examiner* — David Carroll
(74) *Attorney, Agent, or Firm* — Haynes and Boone, LLP

(57) ABSTRACT

A fracture plug seat assembly used in well stimulation for engaging and creating a seal when a plug, such as a ball, is dropped into a wellbore and landed on the fracture plug seat assembly for isolating fracture zones in a well. The fracture plug seat assembly has a fracture plug seat that includes elastomeric material and reinforcing material.

6 Claims, 12 Drawing Sheets

SEAT ASSEMBLY FOR ISOLATING FRACTURE ZONES IN A WELL

CROSS-REFERENCE TO RELATED APPLICATIONS

This patent application is a non-provisional of U.S. patent application Ser. No. 61/559,494, filed Nov. 14, 2011, which is incorporated by reference herein in its entirety.

FIELD OF THE INVENTION

The present invention relates to a fracture plug seat assembly used in well stimulation for engaging and creating a seal when a plug, such as a ball, is dropped into a wellbore and landed on the fracture plug seat assembly for isolating fracture zones in a well. More particularly, the present invention relates to a fracture plug seat that includes elastomeric material and reinforcing material.

BACKGROUND

In well stimulation, the ability to perforate multiple zones in a single well and then fracture each zone independently, referred to as "zone fracturing", has increased access to potential reserves. Many gas wells are drilled with zone fracturing planned at the well's inception. Zone fracturing helps stimulate the well by creating conduits from the formation for the hydrocarbons to reach the well. A well drilled with planned fracturing zones will be equipped with a string of piping below the cemented casing portion of the well. The string is segmented with packing elements, fracture plugs and fracture plug seat assemblies to isolate zones. A fracture plug, such as a ball or other suitably shaped structure (hereinafter referred to collectively as a "ball") is dropped or pumped down the well and seats on the fracture plug seat assembly, thereby isolating pressure from above.

Typically, a fracture plug seat assembly includes a fracture plug seat having an axial opening of a select diameter. To the extent multiple fracture plugs are disposed along a string, the diameter of the respective fracture plug seats becomes progressively smaller with the depth of the string. This permits a plurality of balls having a progressively increasing diameter, to be dropped (or pumped), smallest to largest diameter, down the well to isolate the various zones, starting from the toe of the well and moving up. When the well stimulation in a particular zone is complete, the ball is removed from the fracture plug seat.

In order to maximize the number of zones and therefore the efficiency of the well, the difference in the axial opening diameter of adjacent fracture plug seats and the diameter of the balls designed to be caught by such fracture plug seats is very small, and the consequent surface area of contact between the ball and its seat is very small. Due to the high pressure that impacts the ball during a hydraulic fracturing process, the balls often become stuck and difficult to remove from the fracture plug seats despite being designed to return to the surface due to pressure from within the formation. In such instances, the balls must be removed from the string by costly and time-consuming milling or drilling processes.

FIG. 1 illustrates a prior art fracture plug seat assembly 10 disposed along a tubing string 12. Fracture plug seat assembly 10 includes a metallic, high strength composite or other rigid material seat 14 mounted on a sliding sleeve 16 which is movable between a first position and a second position. In the first position shown in FIG. 1, sleeve 16 is disposed to inhibit fluid flow through radial ports 18 from annulus 20 into the interior of tubing string 12. Packing element 24 is disposed along tubing string 12 to restrict fluid flow in the annulus 20 formed between the earth 26 and the tubing string 12.

FIG. 2 illustrates the prior art fracture plug seat assembly 10 of FIG. 1, but with a ball or fracture plug 28 landed on the metallic, high strength composite or other rigid material seat 14 and with sliding sleeve 16 in the second position. With ball 28 landed on the metallic, high strength composite or other rigid material seat 14, fluid pressure 30 applied from uphole of fracture plug seat assembly 10 urges sliding sleeve 16 into the second position shown in FIG. 2, thereby exposing radial ports 18 to permit fluid flow therethrough.

As shown in FIGS. 1 and 2, the metallic, high strength composite or other rigid material seat 14 has a tapered surface 32 that forms an inverted cone for the ball or fracture plug 28 to land upon. This helps translate the load on the ball 28 from shear into compression, thereby deforming the ball 28 into the metallic, high strength composite or other rigid material seat 14 to form a seal. In some instances, the surface of such metallic, high strength composite or other rigid material seats 14 have been contoured to match the shape of the ball or fracture plug 28. One drawback of such metallic, high strength composite or other rigid material seats 14 is that high stress concentrations in the seat 14 are transmitted to the ball or fracture plug 28. For various reasons, including specific gravity and ease of milling, balls or fracture plugs 28 are often made of a composite plastic. Also, efforts to maximize the number of zones in a well has reduced the safety margin of ball or fracture plug failure to a point where balls or fracture plugs can extrude, shear or crack under the high pressure applied to the ball or fracture plug during hydraulic fracturing operations. As noted above, when the balls 28 extrude into the metallic, high strength composite or other rigid material seat 14 they become stuck. In such instances, the back pressure from within the well below is typically insufficient to purge the ball 28 from the seat 14, which means that an expensive and time-consuming milling process must be conducted to remove the ball 28 from the seat 14.

Other prior art fracture plug seat assembly designs include mechanisms that are actuated by sliding pistons and introduce an inward pivoting mechanical support beneath the ball. These designs also have a metallic, high strength composite or other rigid material seat, but are provided with additional support from the support mechanism.

DETAILED DESCRIPTION

The method and apparatus of the present invention provides a fracture plug seat assembly used in well stimulation for engaging and creating a seal when a plug, such as a ball, is dropped into a wellbore and landed on the fracture plug seat assembly for isolating fracture zones in a well. The fracture plug seat assembly has a fracture plug seat that includes elastomeric material and reinforcing material. When a ball or fracture plug contacts the fracture plug seat, the seat conforms to the contour of the ball or fracture plug, providing nearly uniform pressure across the contact surface, while at the same time, the reinforcing material functions to prevent the elastomeric material from extruding or shearing from the pressure applied to the seat by the ball or fracture plug.

Figure 1:
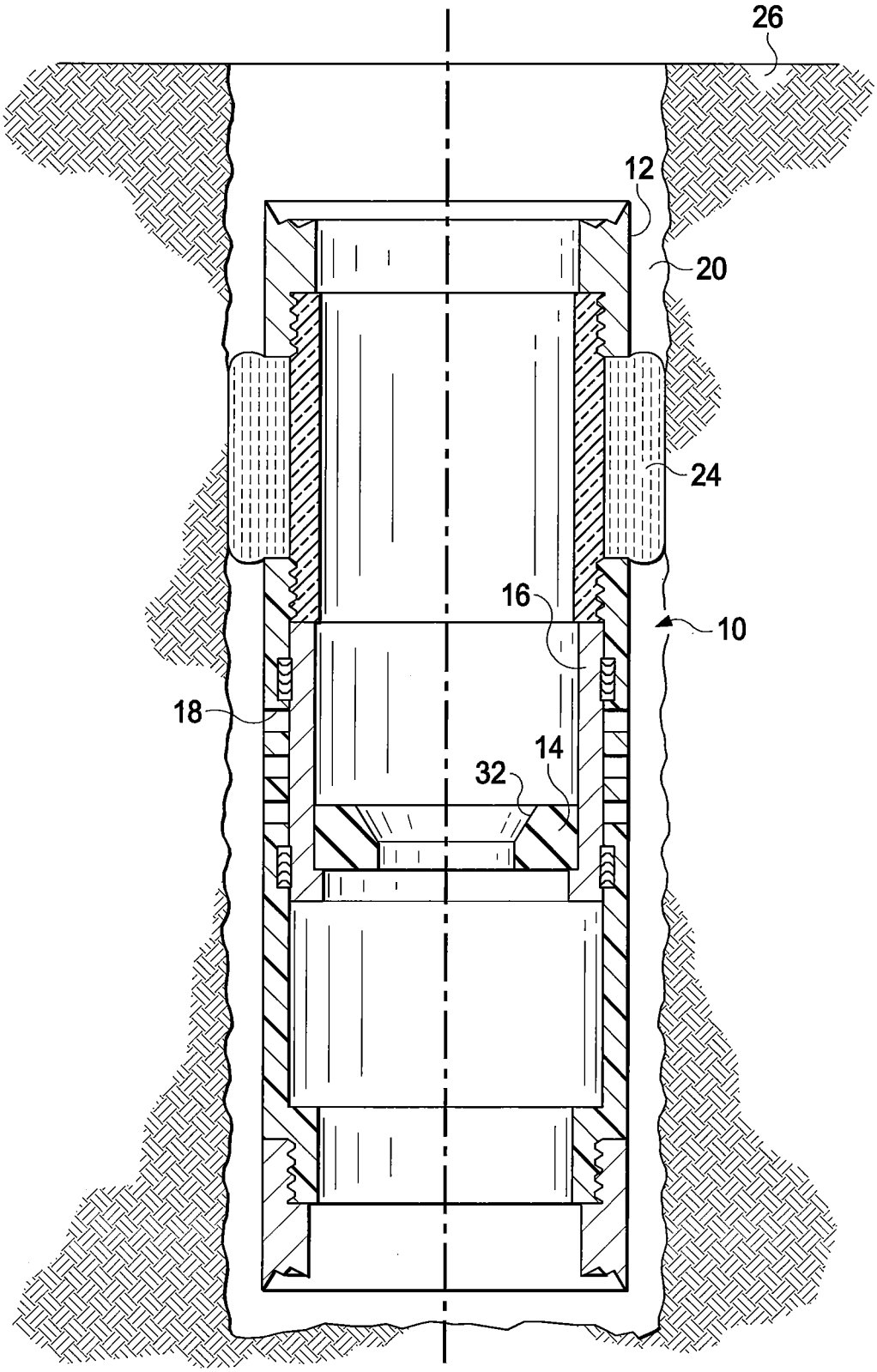
FIG. 1 illustrates a prior art fracture plug seat assembly positioned in a well bore.
Figure 2:
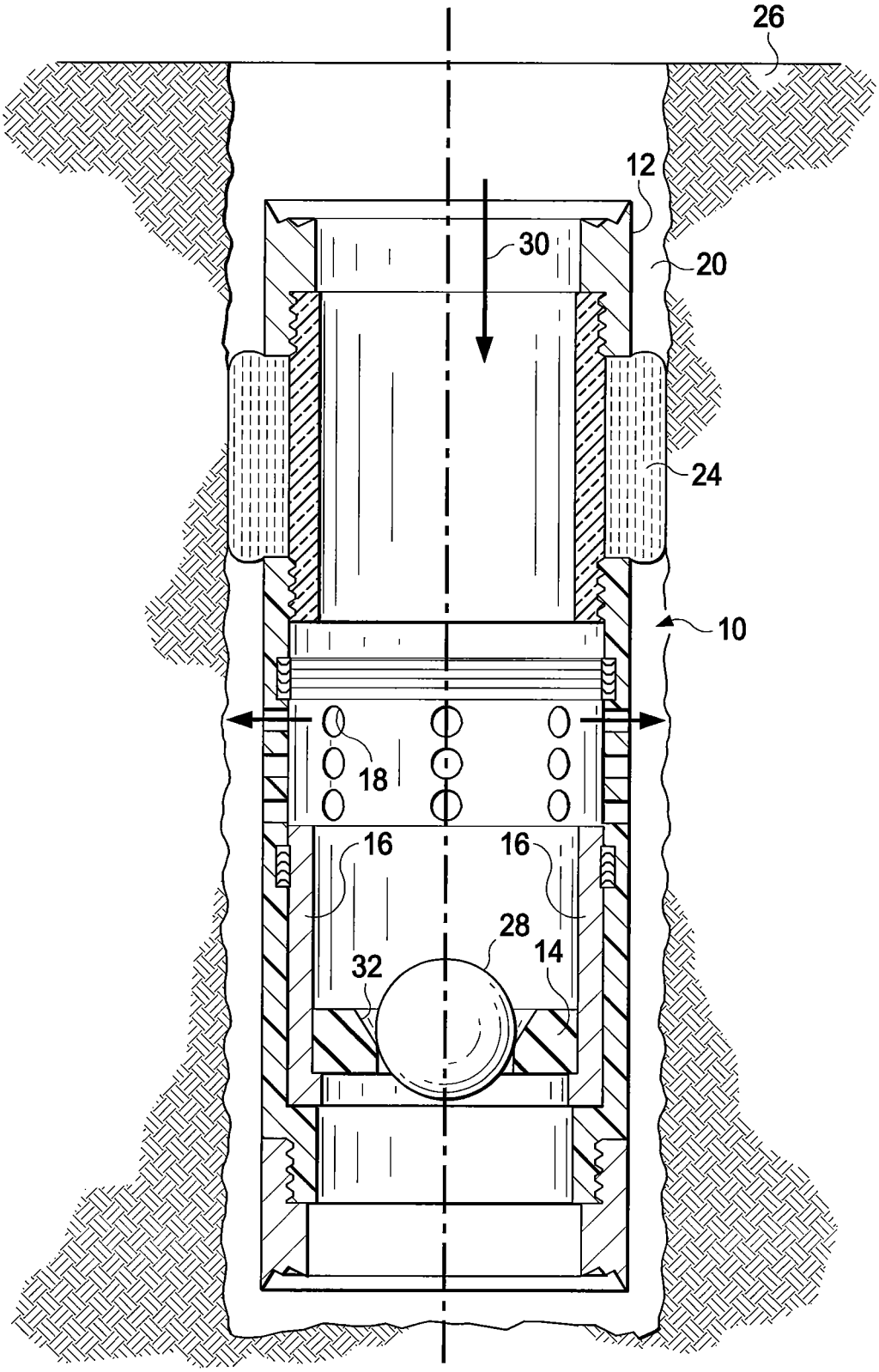
FIG. 2 illustrates the prior art fracture plug seat assembly of FIG. 1 with a ball landed on the seat of the fracture plug seat assembly.
Figure 3:
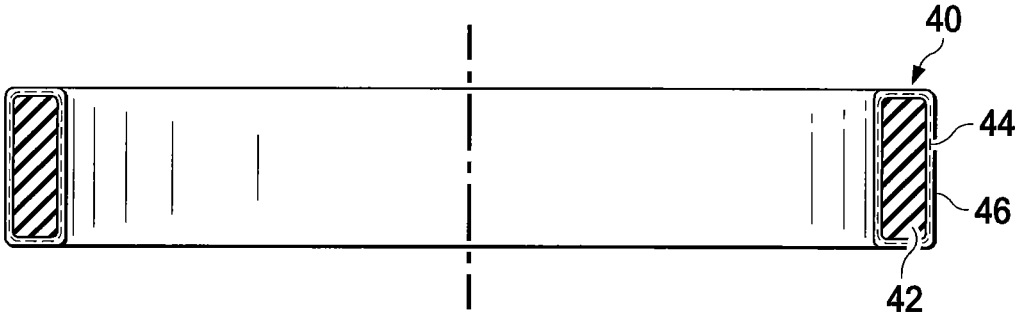
FIG. 3 illustrates a cross-section of an embodiment of a fracture plug seat of the present invention wherein the seat has an elastomeric core and is wrapped with reinforcing material with continuous fibers wound around the cross-sectional axis.

FIG. 3 illustrates a cross-section of an embodiment of a fracture plug seat for use in a fracture plug seat assembly according to the present invention. As shown in FIG. 3, the fracture plug seat 40 includes an elastomeric core 42 with an outer surface 44. A layer of reinforcing material 46 covers the outer surface 44 of the elastomeric core 42.

While FIG. 3 shows the reinforcing material 46 totally encapsulating the elastomeric core 42, it will be understood by those of ordinary skill in the art, that instead, the reinforcing material 46 may only partially cover the elastomeric core 42.

Figure 4:
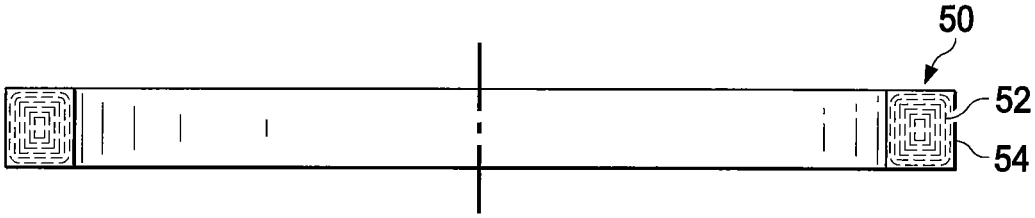
FIG. 4 illustrates a cross-section of an embodiment of a fracture plug seat of the present invention wherein the seat has an elastomeric core and includes a plurality of layers of reinforcing material with continuous fibers would around the cross-sectional axis.

FIG. 4 illustrates a cross-section of an embodiment of a fracture plug seat for use in a fracture plug seat assembly according to the present invention. As shown in FIG. 4, the fracture plug seat 50 includes an elastomeric core 52 that includes a plurality of layers of reinforcing material 54. Those of ordinary skill in the art will recognize that the elastomeric core 52 can be infinitesimally small.

Figure 5:
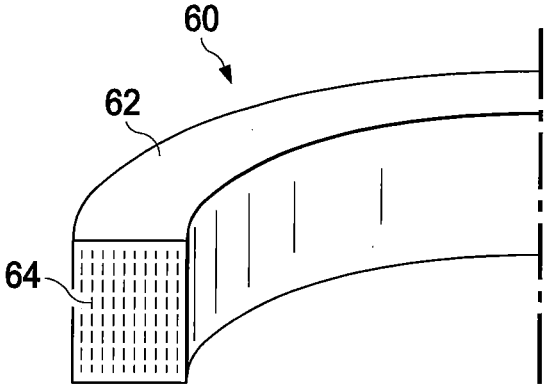
FIG. 5 illustrates a cross-section of an embodiment of a fracture plug seat of the present invention with a plurality of layers of calendared elastomeric/fiber strips having the layers wound around the axis of the ring stacked radially.

FIG. 5 illustrates a cross-section of an embodiment of a fracture plug seat for use in a fracture plug seat assembly according to the present invention. As shown in FIG. 5, the fracture plug seat 60 includes an elastomeric body 62 with a plurality of layers of reinforcing material 64 wound around the axis of the fracture plug seat 60 and stacked radially. According to certain embodiments, the fracture plug seat 60 is wrapped in the reinforcing material 64 and prior to wrapping, the reinforcing material 64 is calendared to a sheet of elastomeric material. According to certain embodiments, the fracture plug seat 60 includes a plurality of layers of calendared strips of elastomeric material and reinforcing material.

Figure 6:
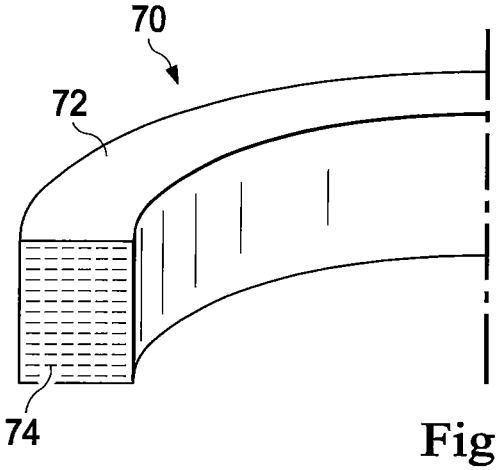
FIG. 6 illustrates a cross-section of an embodiment of a fracture plug seat of the present invention with a plurality of layers of calendared elastomeric/fiber strips having the layers wound around the axis of the ring stacked axially.

FIG. 6 illustrates a cross-section of an embodiment of a fracture plug seat for use in a fracture plug seat assembly according to the present invention. As shown in FIG. 6, the fracture plug seat 70 includes an elastomeric body 72 with a plurality of layers of reinforcing material 74 wound around the axis of the fracture plug seat 70 and stacked axially. According to certain embodiments, the fracture plug seat 70 is wrapped in the reinforcing material 74 and prior to wrapping, the reinforcing material 74 is calendared to a sheet of elastomeric material. According to certain embodiments, the fracture plug seat 70 includes a plurality of layers of calendared strips of elastomeric material and reinforcing material.

While four specific orientations of the reinforcing material with respect to the elastomeric core are depicted in FIGS. 3, 4, 5 and 6, those of ordinary skill in the art will appreciate that the present invention is not limited to a particular orientation of the layers of reinforcing material so long as the reinforcing material provides the reinforcement function described herein.

According to certain embodiments of the present invention, the fracture plug seat of the fracture plug seat assembly includes one or more elastomeric materials such as hydrogenated nitrile butadiene rubber ("HNBR"), nitrile butadiene rubber ("NBR"), perfluoro-elastomers ("FFKM"), tetrafluoro ethylene/propylene copolymer rubbers ("FEPM"), fluoro-elastomers ("FKM"), neoprene and natural rubber.

According to certain embodiments of the present invention, the reinforcing material of the fracture plug seat of the fracture plug seat assembly is a flexible woven or non-woven material that includes a network of natural or artificial fibers. The reinforcing material may be formed by methods such as weaving, knitting, crocheting, knotting, pressing fibers together or any other means for interlacing fibers. According to certain embodiments of the present invention, the reinforcing material may be present in the form of a continuous sheet or strips. According to certain embodiments, the reinforcing material is a fibrous woven or non-woven cloth that is calendared to a sheet of elastomeric material.

According to certain embodiments, such as shown in FIG. 3, the reinforcing material 46 is disposed around the elastomeric core 42 to at least partially encapsulate the elastomeric core 42.

According to certain embodiments, such as shown in FIG. 4, the reinforcing material 54 is spirally wrapped around the elastomeric core 52.

In certain other embodiments, the reinforcing material may be wrapped or otherwise applied to the elastomeric core so that individual fibers of the reinforcing material are orthogonal or parallel to the axis of the fracture plug seat or the direction of deformation under application of a force from a ball or fracture plug.

According to certain embodiments of the present invention, the reinforcing material may be applied to the elastomeric core as a single layer or as multiple layers.

According to certain embodiments of the present invention, the reinforcing material may be bonded or otherwise adhered to the elastomeric core. According to certain other embodiments, such as illustrated in FIG. 3, the reinforcing material may be disposed about the elastomeric core without being affixed thereto. According to still other embodiments of the present invention, the reinforcing material and the elastomeric core are calendared during manufacture of the fracture plug seat assembly to bond the reinforcing material to the elastomeric core.

The reinforcing material is not limited to a particular type of material so long as the material is sufficiently flexible to allow some deformation of the elastomeric core under pressure from a ball or fracture plug and resistant to the high pressure, high temperature and fluids commonly present in a wellbore. According to one embodiment of the present invention, the reinforcing material has high strength capacities. In other embodiments of the present invention, the reinforcing material may include one or more of the following materials: aramid fibers such as Nomex™, glass fibers, carbon fibers, boron fibers, polymer fibers, polyamide fibers, polypropylene fibers, polyethylene fibers, cotton fibers and ceramic fibers. According to still other embodiments the reinforcing material may include polypropylene or polyester fibers in the form of a geotextile.

The fracture plug seat according to the present invention, may be of any particular shape or configuration so long as it performs the functions as described herein. According to one embodiment, the elastomeric core includes one or more segments to form a ring, the cross-section of which is illustrated in FIGS. 3 and 4.

Figure 7:
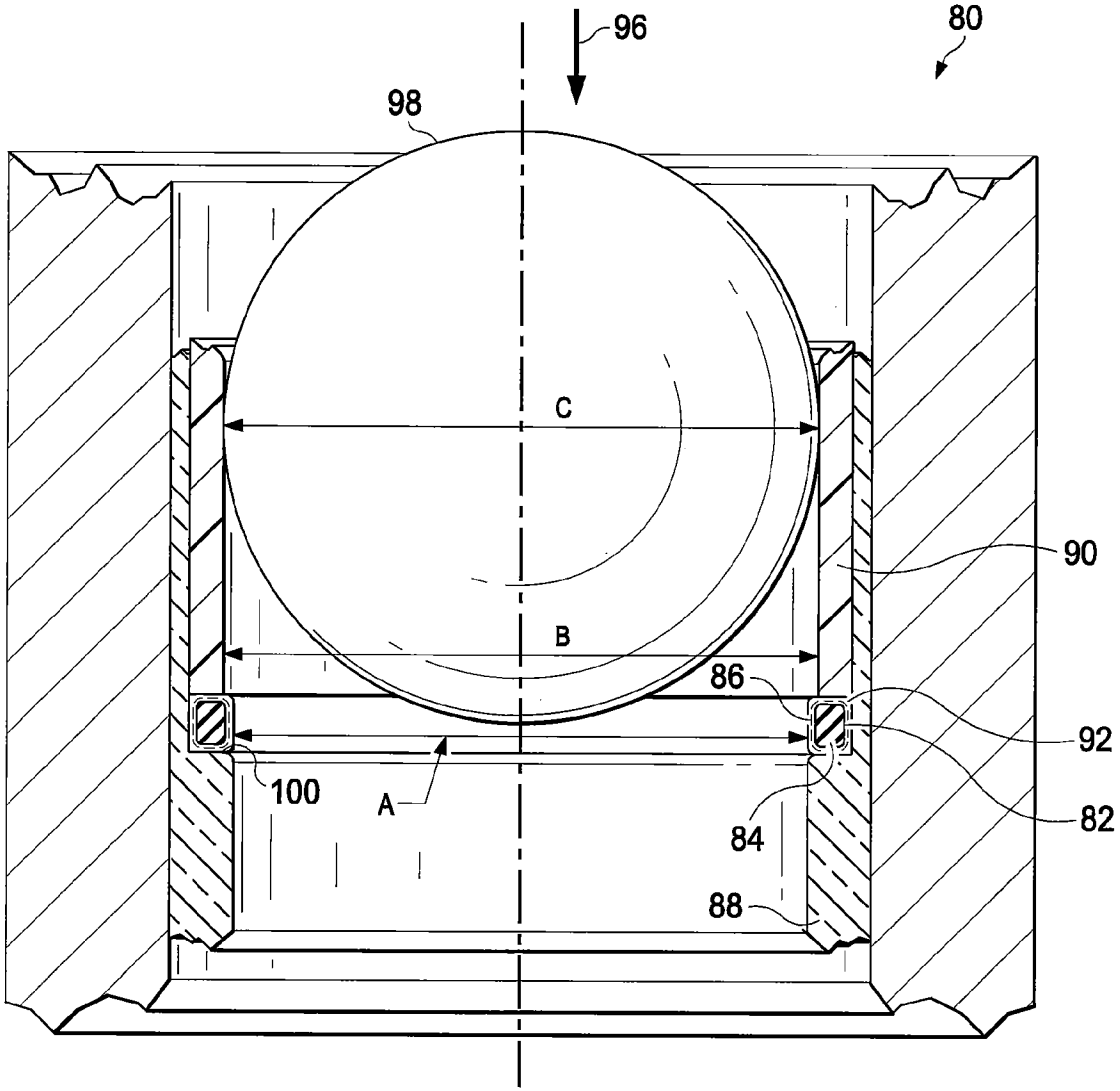
FIG. 7 illustrates a cross-section of a fracture plug seat assembly incorporating an embodiment of the fracture plug seat of the present invention.

FIG. 7 illustrates a fracture plug seat assembly 80 incorporating a fracture plug seat 82 as described above. As shown, fracture plug seat 82, which includes elastomeric core 84 and reinforcing material 86, is mounted on sliding sleeve 88. As shown in FIG. 7, the sliding sleeve 88 includes an inwardly extending shoulder 100 and the fracture plug seat 82 abuts the shoulder 100. A retaining ring or similar structure 90 engages sliding sleeve 88 in order to secure fracture plug seat 82 thereon. Alternatively, or in addition thereto, sliding sleeve 88 may be provided with a radial groove or cavity 92 for seating fracture plug seat 82.

Continuing with FIG. 7, in certain embodiments, the retaining ring 90 may be mounted on sliding sleeve 88 to constrain fracture plug seat 82 after it has been mounted on sliding sleeve 88. In all embodiments, the fracture plug seat 82 is sufficiently constrained within cavity 92 to withstand dislodgement under a fluid pressure 96 placed on fracture plug seat 82 by ball 98 during a fracturing operation, but is sufficiently exposed to contact with ball 98 so as to permit deformation and mating with ball 98 under the pressure applied by ball 98. Moreover, to provide sufficient pressure to ball 98 without shearing the elastomeric core 84 of the fracture plug seat 82, the fracture plug seat 82 may be constrained within cavity 92. The reinforcing material 86 of the fracture plug seat 82 is provided to control the deformation of the elastomeric core 84 and prevent the shearing of the elastomeric core 84 under contact from ball 98 and preventing the elastomeric core 84 from bursting into an unsupported area.

As shown in FIG. 7, fracture plug seat 82 has an axial opening having a diameter A, retaining ring 90 has an axial opening having a diameter B and ball 98 has a diameter of C. The diameter C of ball 98 is very slightly smaller than the diameter B of the axial opening of retaining ring 90 so that ball 98 passes freely through the retaining ring 90. The diameter C of ball 98 is larger than the diameter A of the axial opening of the fracture plug seat 82 so that ball 98 cannot pass through the fracture plug seat 82.

Figure 8:
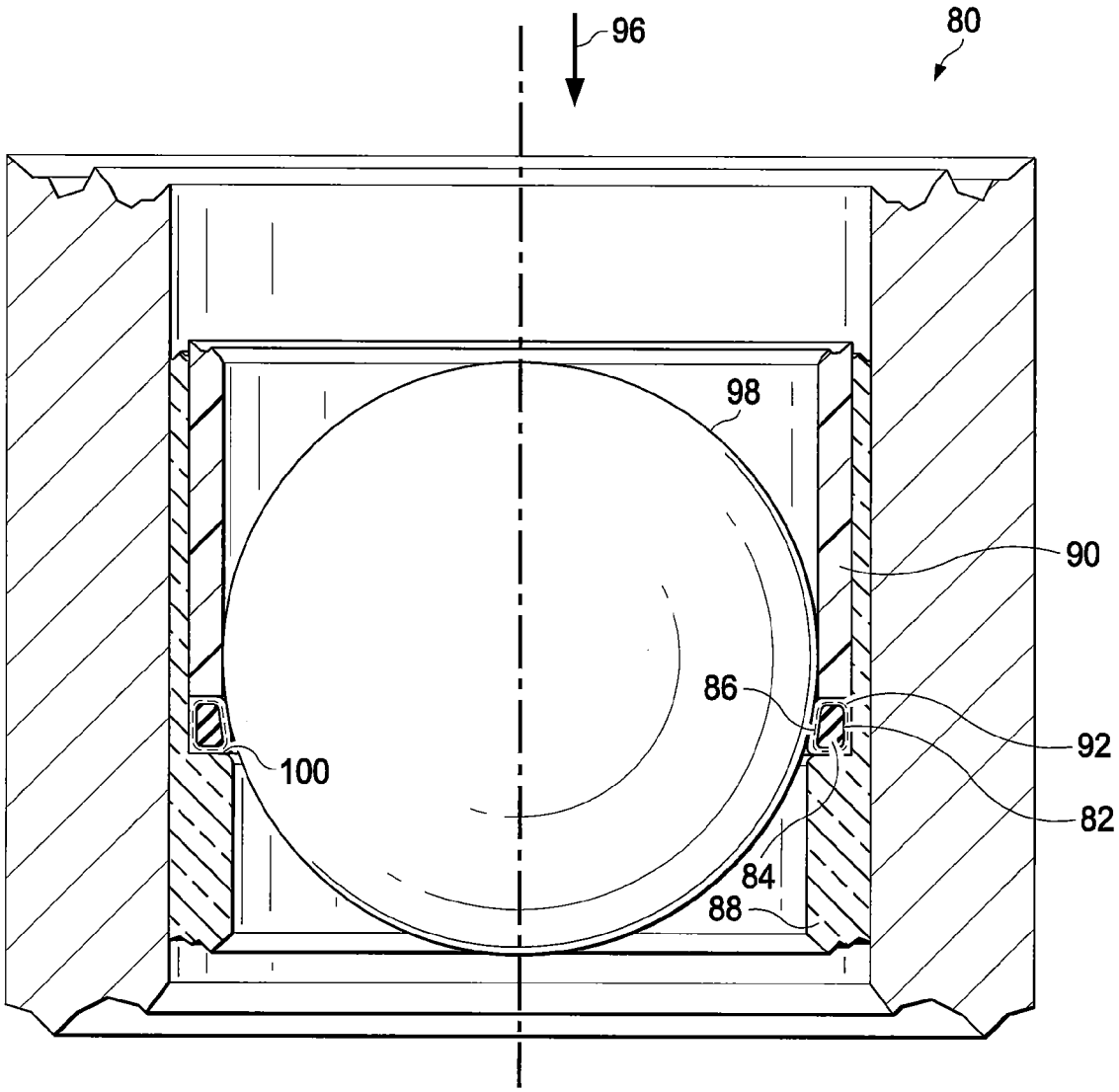
FIG. 8 illustrates the fracture plug seat assembly of FIG. 7 with a ball landed on the seat of the fracture plug seat assembly and applying pressure to the fracture plug seat assembly.

FIG. 8 illustrates the fracture plug seat assembly 80 incorporating the fracture plug seat 82 as shown in FIG. 7, in which ball 98 is shown as having landed on fracture plug seat 82 and fluid pressure 96 deforms the fracture plug seat 82 to take on the partial contour of ball 98. The reinforcing material 86 constrains the elastomeric core 84 of the fracture plug seat 82 from permanently deforming or yielding such that in combination the fracture plug seat 82 is incredibly strong and has a high modulus and low elongation especially when compared to an elastomeric fracture plug seat that does not include the reinforcing material. Upon completion of a hydraulic fracturing operation or when fluid pressure 96 is otherwise removed, fluid pressure downhole of fracture plug seat assembly 80 will dislodge ball 98 from fracture plug seat 82 and fracture plug seat 82 will have sufficient resilience to rebound to a shape which will allow smaller balls from downstream zones to pass freely therethrough. Also, the elastomeric core 84 of the fracture plug seat 82 functions as a spring to help push the ball 98 upward as the deformed fracture plug seat 82 returns to its original shape and configuration.

Figure 9:
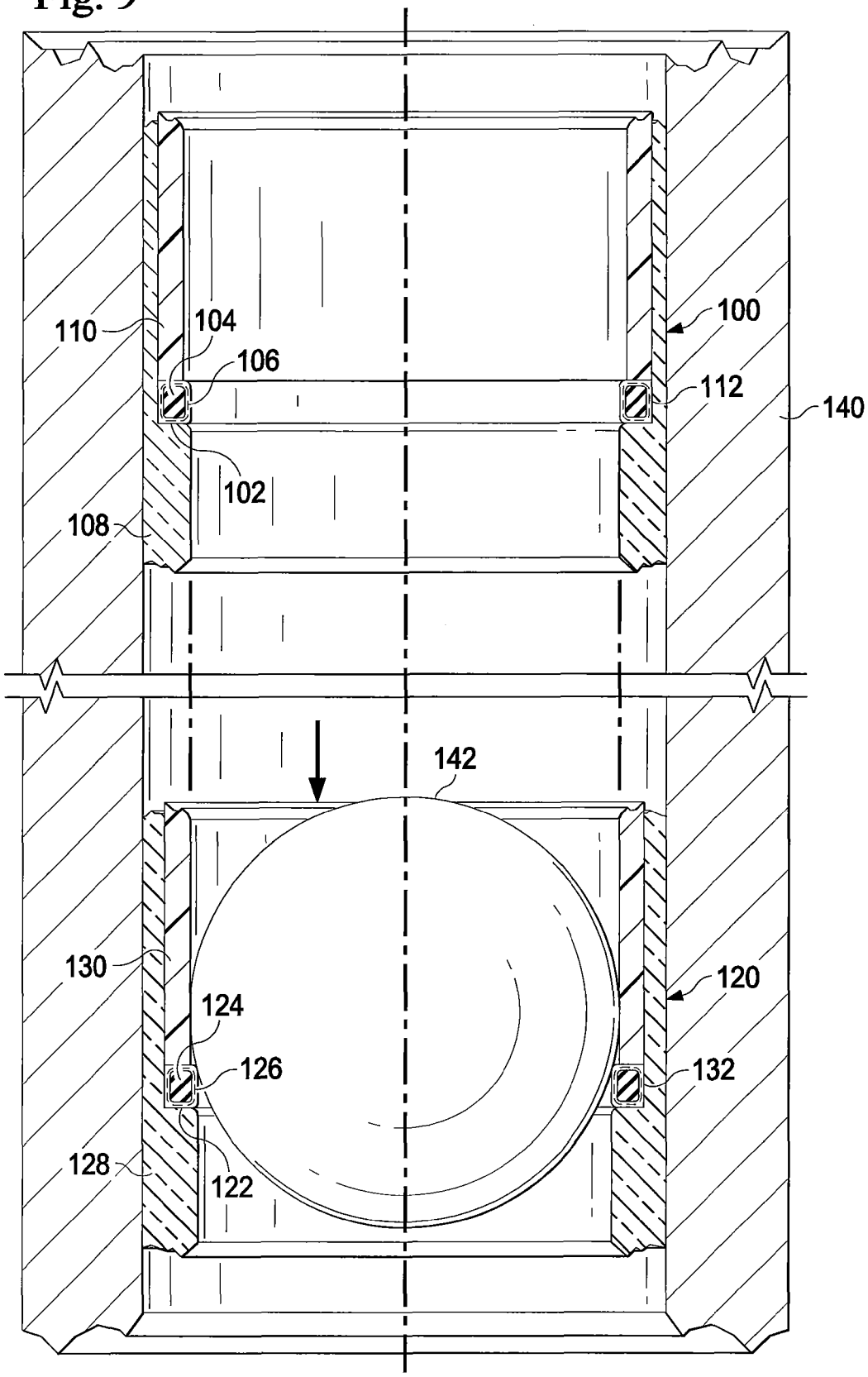
FIG. 9 illustrates two adjacent fracture plug seat assemblies with a ball landed on the seat of the lower fracture plug seat assembly.

FIG. 9 illustrates adjacent fracture plug seat assemblies 100 and 120 which incorporate fracture plug seats 102 and 122, respectively. As shown, fracture plug seat 102 includes elastomeric core 104 and reinforcing material 106 and is mounted on sliding sleeve 108. A retaining ring or similar structure 110 engages sliding sleeve 108 in order to secure fracture plug seat 102 thereon. Alternatively, or in addition thereto, sliding sleeve 108 may be provided with a radial groove or cavity 112 for seating fracture plug seat 102.

Similarly, fracture plug seat 122 includes elastomeric core 124 and reinforcing material 126 and is mounted on sliding sleeve 128. A retaining ring or similar structure 130 engages sliding sleeve 128 in order to secure fracture plug seat 122 thereon. Alternatively, or in addition thereto, sliding sleeve 128 may be provided with a radial groove or cavity 132 for seating fracture plug seat 122.

In FIG. 9, the metal pipe assembly known as string 140 has had a long section removed so as to depict fracture plug seat assemblies 100 and 120 in one illustration. As shown in FIG. 9, ball 142 has landed on fracture plug seat 122 after passing through retaining ring 110, fracture plug seat 102 and sliding sleeve 108.

Figure 10:
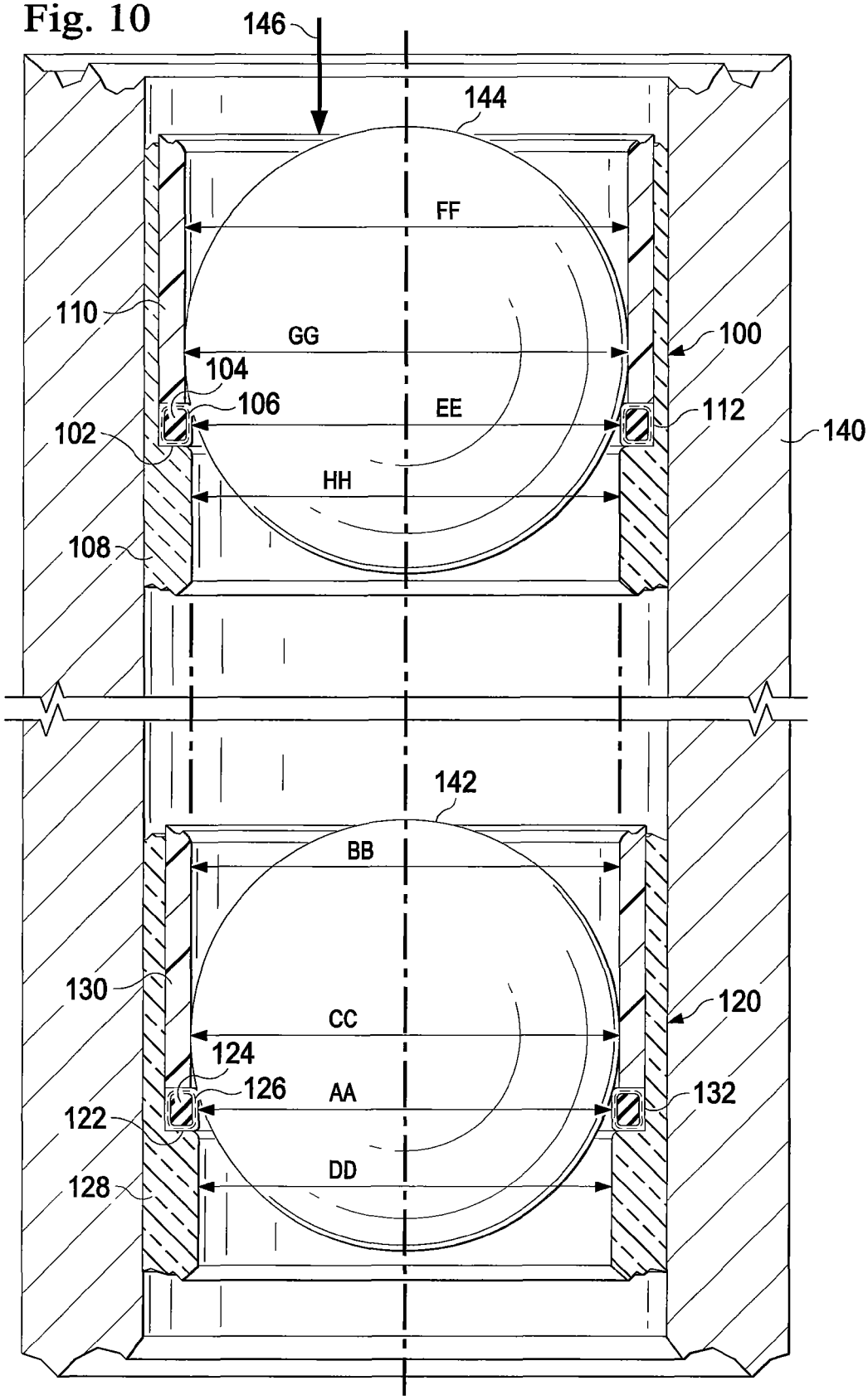
FIG. 10 illustrates the two adjacent fracture plug seat assemblies of FIG. 9 with a ball landed on the fracture plug seat of both of the fracture plug seat assemblies.

FIG. 10 illustrates the fracture plug seat assemblies 100 and 120 incorporating the fracture plug seats 102 and 122 as shown in FIG. 9, wherein a ball 144 has been dropped from the direction of arrow 146. As shown in FIG. 10, fracture plug seat 122 has an axial opening having a diameter AA, retaining ring 130 has an axial opening having a diameter BB, ball 142 has a diameter of CC, and sliding sleeve 128 has an axial opening having a diameter of DD. The diameter CC of ball 142 is very slightly smaller than the diameter BB of the axial opening of retaining ring 130 so that ball 142 passes freely through the retaining ring 130. The diameter CC of ball 142 is larger than the diameter AA of the axial opening of the fracture plug seat 122 so that ball 142 cannot pass through the fracture plug seat 122.

Also, as shown in FIG. 10, fracture plug seat 102 has an axial opening having a diameter EE, retaining ring 110 has an axial opening having a diameter FF, ball 144 has a diameter of GG and sliding sleeve 108 has an axial opening having a diameter HH. The diameter GG of ball 144 is very slightly smaller than the diameter FF of the axial opening of retaining ring 110 so that ball 144 passes freely through the retaining ring 110. The diameter GG of ball 144 is larger than the diameter EE of the axial opening of the fracture plug seat 102 so that ball 144 cannot pass through the fracture plug seat 102.

As further shown in FIG. 10, the diameter CC of ball 142 is less than the diameter EE of the axial opening of the fracture plug seat 102, the diameter FF of the axial opening of retaining ring 110 and the diameter HH of the axial opening of sliding sleeve 108 so that ball 142 passes freely through the fracture plug seat assembly 100. In order to optimize the number of separately addressable zones in a wellbore, according to one embodiment, for adjacent fracture plug seat assemblies, the diameter of the axial opening of the sliding sleeve of the uphole fracture plug seat assembly, such as diameter HH of the axial opening of sliding sleeve 108, is approximately equal to the diameter of the axial opening of the retaining ring of the downhole fracture plug seat assembly, such as diameter BB of the axial opening of retaining ring 130.

As shown in FIG. 10, the diameter GG of ball 144 is larger than the diameter CC of ball 142. According to certain embodiments, the difference between the diameter DD of the axial opening of sliding sleeve 128 and the diameter BB of the axial opening of retaining ring 130 is equal to the difference between the diameter GG of ball 144 and the diameter CC of ball 142.

Pressure from fracturing the zone designated by fracture plug seat assembly 120 still remains to keep ball 142 in place landed on fracture plug seat 122. However, fracturing fluid from the surface can no longer pass by ball 144 and fracture plug seat assembly 100. Again, in order to optimize the number of separate addressable zones in a wellbore, according to certain embodiments, the retaining ring 110 is rigidly connected to sliding sleeve 108 and the diameter FF of the axial opening of retaining ring 110 closely receives ball 144. Such an arrangement assists in restricting fracture plug seat 102 from extruding due to pressure exerted by ball 144 which is subject to pressure 146. According to still other embodiments, the diameter HH of the axial opening of sliding sleeve 108 and the diameter FF of the axial opening of retaining ring 110 are as small as possible to provide the most support for the ball 144, while still allowing the smaller ball 142 to pass through.

Figure 11:
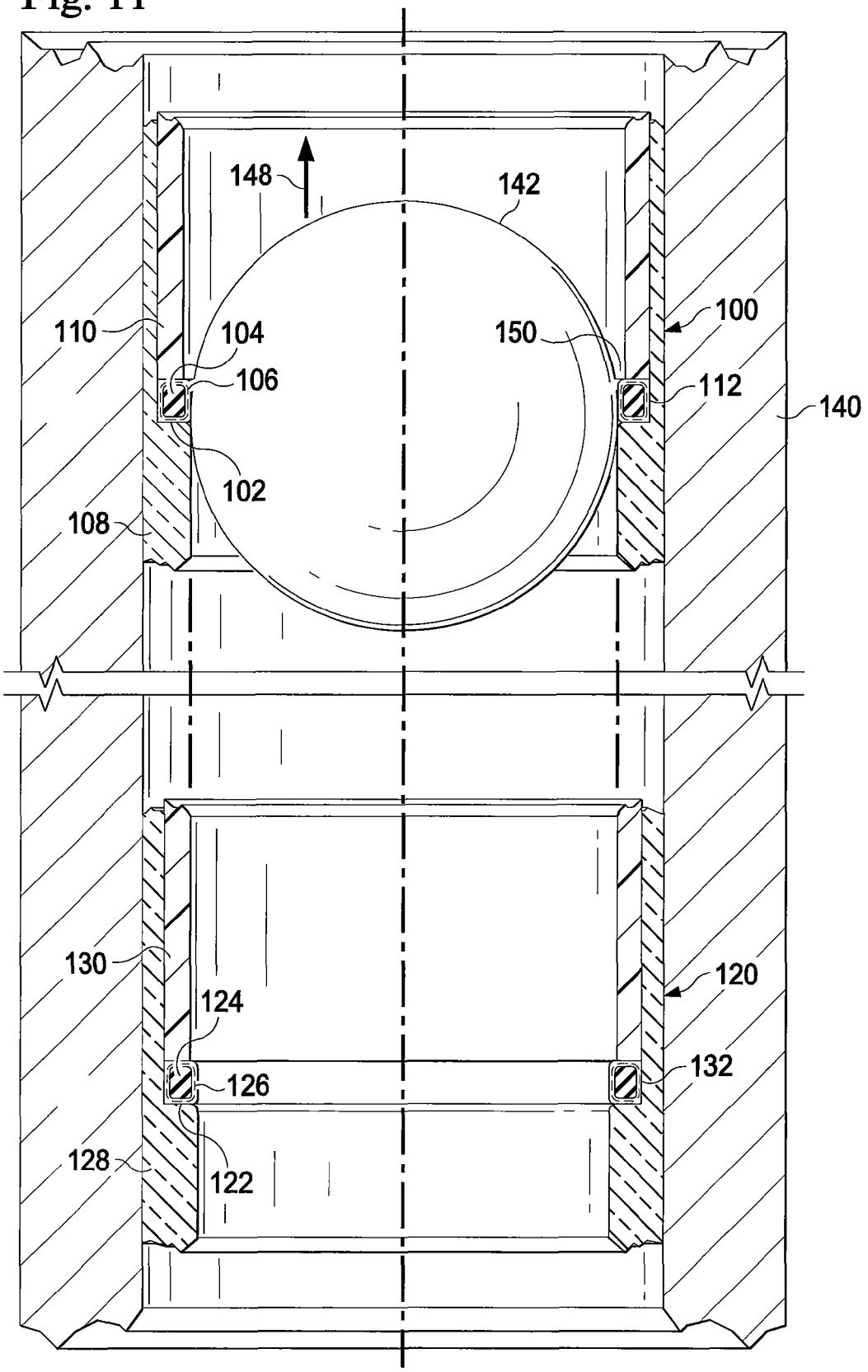
FIG. 11 illustrates the two adjacent fracture plug seat assemblies of FIG. 10 in a condition in which the ball that had been landed on the upper fracture plug seat has already been purged from the wellbore and the ball that had been landed on the lower fracture plug seat is passing through the upper fracture plug seat.

FIG. 11 illustrates the fracture plug seat assemblies 100 and 120 incorporating the fracture plug seats 102 and 122 as shown in FIG. 9, but at a different phase of a fracturing sequence than shown in FIG. 10. Specifically, FIG. 11 depicts the condition when pressure 146 has been released and the ball 144 has been purged by trapped pressure between ball 142 and ball 144. In FIG. 11, the smaller ball 142 is now passing through the fracture plug seat 102 in the direction 148. The open area 150 between the inner diameter of the retaining ring 110 and the ball 142 provides room for any displaced material from the fracture plug seat 102 to elastically form into to allow the ball 142 to easily pass.

Figure 12:
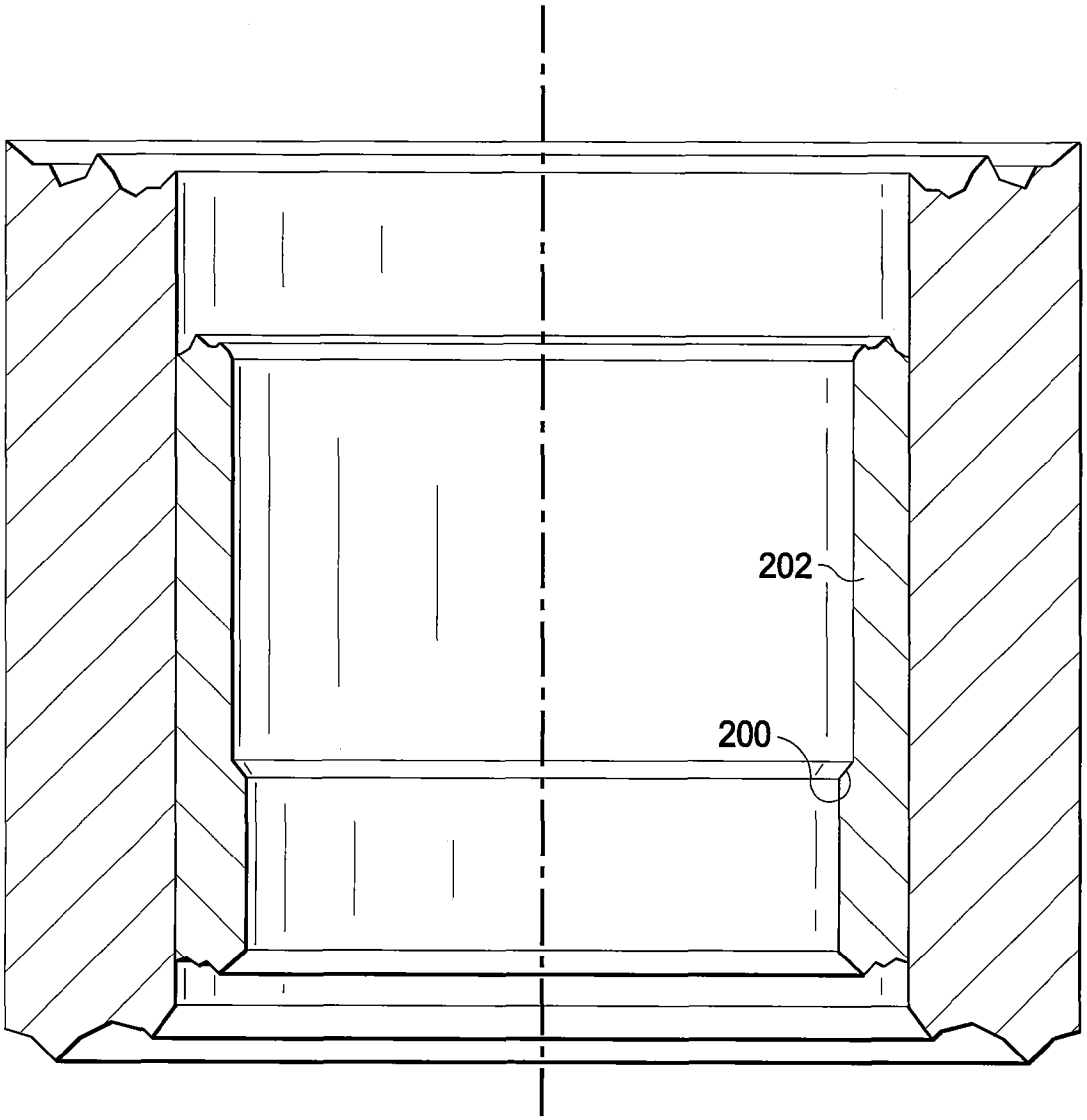
FIG. 12 illustrates a cross-section of a prior art metal fracture plug seat.

FIG. 12 illustrates a prior art metal check valve seat that is currently used in many applications. Specifically, a hard metal seat 200 is integrated within a sliding sleeve 202. Such hard metal seats are commonly disposed at various angles or shapes to contact a ball. In such arrangements, the balls are often made of drillable materials that are easily cut or fractured. The hard metal seat 200, however, can create a stress concentration and crack the received ball or cut into the ball and shear the outer diameter from the ball.

Figure 13:
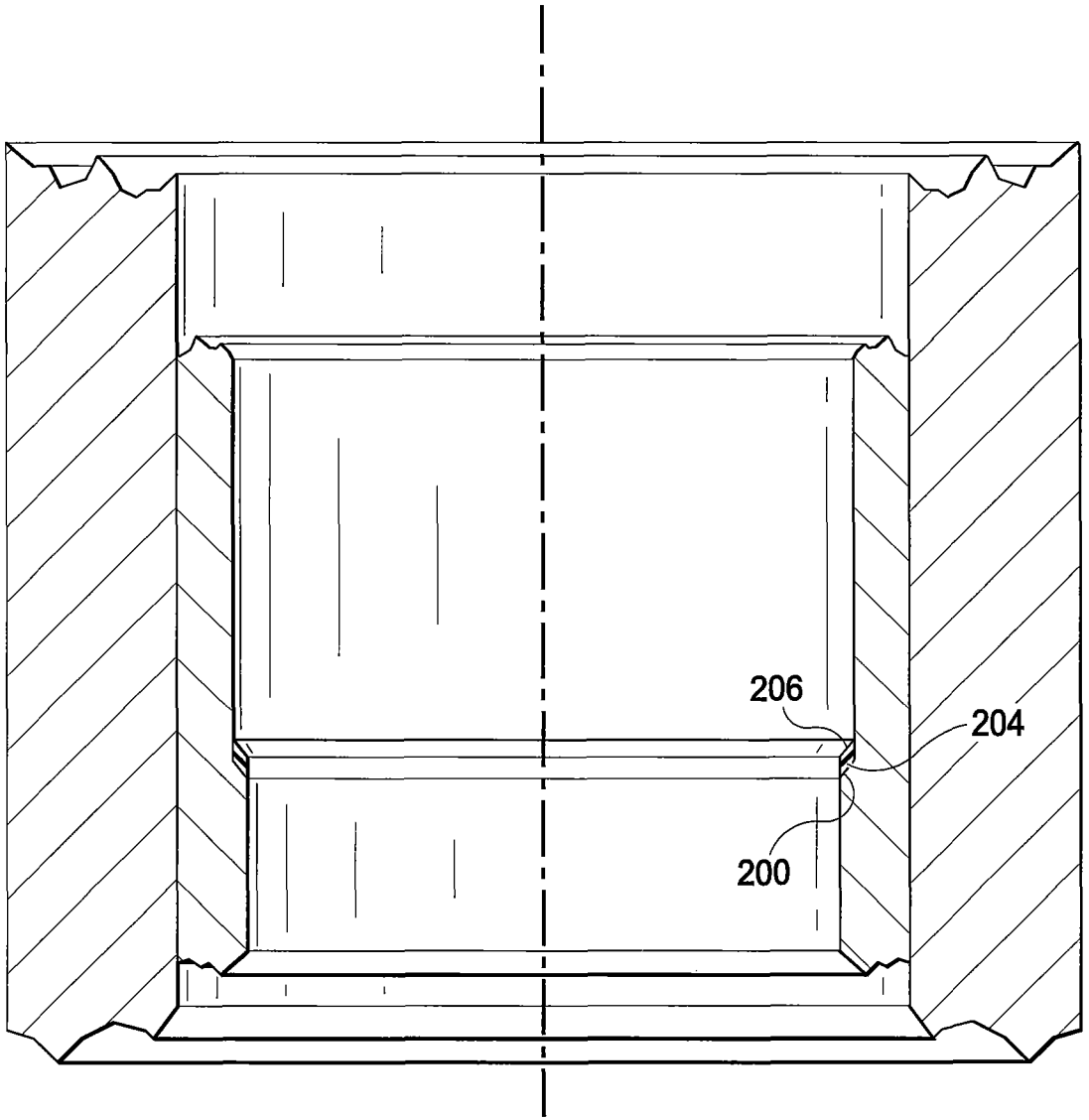
FIG. 13 illustrates a cross-section of an embodiment of a fracture plug seat of the present invention wherein the seat includes elastomeric material and reinforcing material.

FIG. 13 illustrates a modification of the metal check valve seat shown in FIG. 12, with an elastomeric seat 204 according to the present invention. Specifically, as shown in FIG. 13, an elastomeric seat 204 including reinforcing material 206 covers the hard seat 200 to remove stress concentrations or eliminate sharp edges that may tend to crack or cut a fracture plug or ball that is landed on the elastomeric seat 204. Without the reinforcing material 206, the pressure exerted on the elastomeric seat 204 by the fracture plug or ball would pulverize and rupture the elastomeric seat 204.

Figure 14:
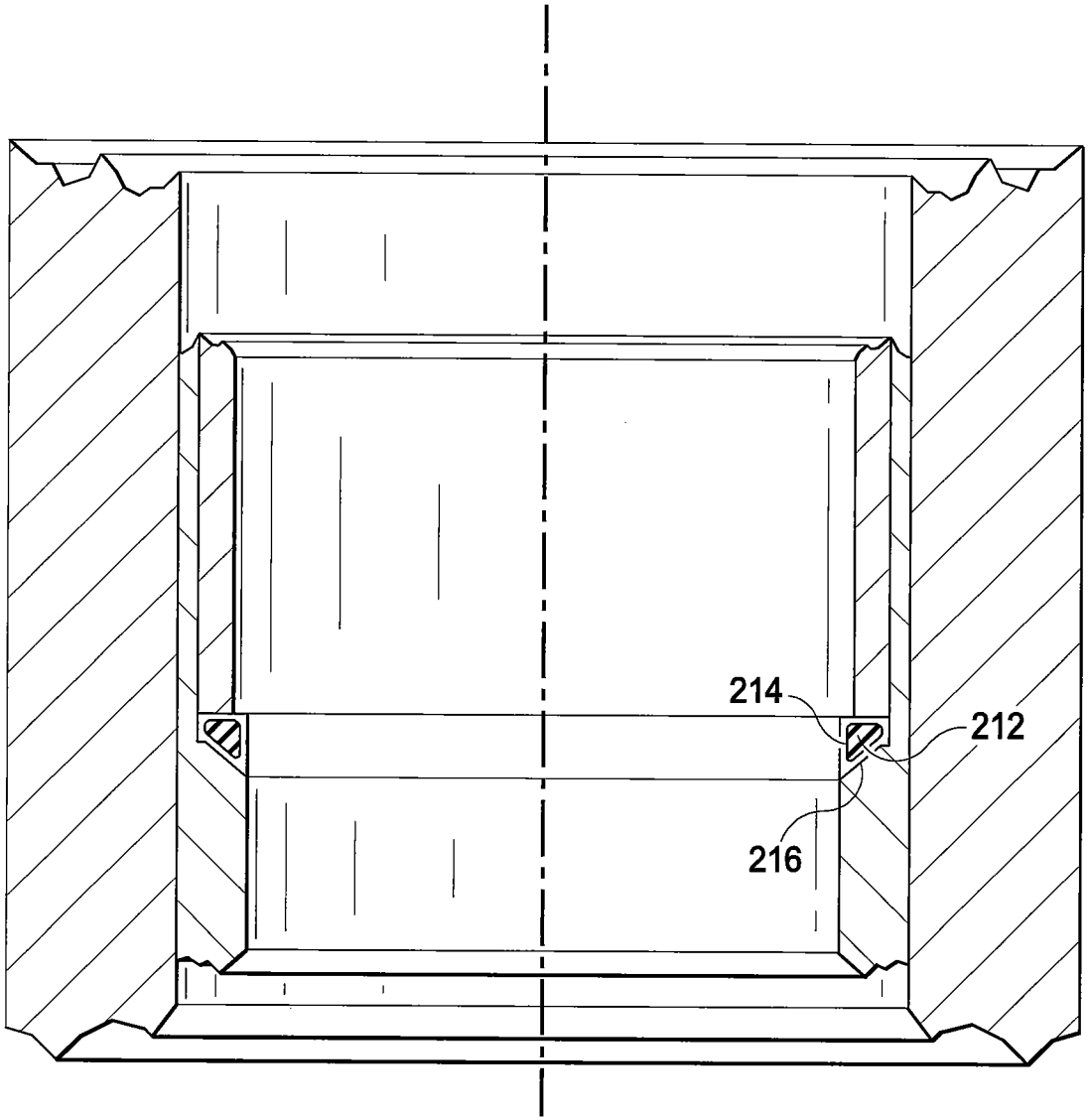
FIG. 14 illustrates a cross-section of an embodiment of a fracture plug seat of the present invention wherein the seat has an elastomeric core and is wrapped with a reinforcing material.

FIG. 14 illustrates yet another modification of the metal check valve seat shown in FIG. 12, with an elastomeric seat 212 according to the present invention. Specifically, as shown in FIG. 14, an elastomeric seat 212 includes a layer of reinforcing material 214 that functions as a protective barrier between the hard metal seat 216 and a fracture plug or ball that is landed on the elastomeric seat 212. Elastomeric seat 212 is supported on all sides that will not engage the fracture plug or ball.

In an exemplary embodiment, a kit is provided for enabling zone fracturing in a hydrocarbon well. The kit can be adapted and used for various applications including, but not limited to, fracturing in a vertical or horizontal well as well as a gas or oil well. The kit includes a plurality of fracture plug seats, balls, sliding sleeves and retaining rings. Specifically, the kit includes matched sets of such fracture plug seats, balls, sliding sleeves and retaining rings for each zone to be fractured. For the deepest zone to be fractured, the fracture plug seat has an axial opening with a diameter that is sufficiently small to land the ball but not allow the ball to pass and is equal to the diameter of the axial opening defined by a shoulder on the sliding sleeve. The diameter of the axial opening of the retaining ring is approximately equal to the diameter of the ball but is sufficient to permit the ball to easily pass through the axial opening of the retaining ring so that the ball contacts and is landed on the fracture plug seat. The diameter of the axial opening of the retaining ring for the deepest zone to be fractured is approximately equal to the diameter of the axial opening of the fracture plug seat and the diameter of axial opening defined by the shoulder on the sliding sleeve for the next zone up the wellbore to be fractured. The remaining components of the matched set for the next zone up the wellbore to be fractured have the same diametrical relationships as discussed above for the deepest zone to be fractured. Each matched set then follows this same pattern. The kit includes as many matched sets of fracture plug seats, balls, sliding sleeves and retaining rings having the relationships described above as desired for a particular wellbore. Those of ordinary skill in the art will recognize that the relationships between the various components described above enables the fracturing of as many zones as possible in a wellbore. Those of ordinary skill in the art will also recognize that the kit can be arranged such that the diameter of the axial opening defined by the shoulder on the sliding sleeve for a zone of the wellbore to be fractured can be larger than the diameter of the axial opening of the retaining ring of the lower adjacent zone and so on. The directions included with the kit are instructions for designing a zone fracturing plan.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

What is claimed:

1. A method for fracturing the formation around a wellbore, the method comprising the steps of:

deploying a pipe string into a wellbore, the pipe string having perforations disposed in a wall of the pipe string and a fracture plug seat positioned in the interior of the pipe string;

setting packers above and below the perforations to seal the annulus formed between the pipe string and the formation;

introducing a ball into the pipe string;

seating the ball on the fracture plug seat by applying a fluid pressure to the ball; and controlling deformation of the fracture plug seat by at least partially covering the fracture plug seat with a reinforcing material arranged to constrain the fracture plug seat from permanently deforming to a deformed shape under the load, the fracture plug seat having sufficient resilience to rebound to a shape allowing relatively smaller downstream balls to pass therethrough.

2. The method of claim 1, wherein the fracture plug seat partially deforms to fit the contour of the ball.

3. A kit for enabling zonal fracturing in a wellbore, said kit comprising:

a plurality of matched sets of sleeves, fracture plug seats, retaining rings and balls, wherein each matched set comprises:

a sleeve adapted for being slidingly mounted adjacent an interior surface of a tubular mandrel, the sleeve comprising an interior surface along which is defined a shoulder, the shoulder defining an axial opening having a first diameter;

a fracture plug seat for mounting on the sleeve to abut the shoulder, the fracture plug seat comprising an elastomeric ring comprising reinforcing material and having an axial opening, the diameter of the axial opening of the fracture plug seat being approximately equal to the first diameter;

a retaining ring for mounting on the sleeve and disposed adjacent the fracture plug seat to thereby constrain the fracture plug seat between the shoulder and the retaining ring, the retaining ring having an axial opening having a second diameter, the second diameter being larger than the first diameter; and a ball for being landed on the fracture plug seat, the ball having a diameter than is approximately equal to the second diameter; and wherein the plurality of matched sets of sleeves, fracture plug seats, retaining rings and balls are related such that in adjacent matched sets, the diameter of the axial opening of the retaining ring for the deeper zone to be fractured is approximately equal to the diameter of the axial opening of the fracture plug seat and the diameter of the axial opening defined by the shoulder on the sleeve for the shallower zone to be fractured.

4. The kit of claim 3, wherein the reinforcing material is selected from the group consisting of aramid fibers, glass fibers, carbon fibers, boron fibers, polyester fibers, polyamide fibers, polypropylene fibers, polyethylene fibers, cotton fibers and ceramic fibers.

5. The kit of claim 3, wherein the reinforcing material covers a portion of the elastomeric member.

6. The kit of claim 5, wherein the reinforcing material covers the entire outer surface of the elastomeric member.

* * * * *